US005651911A

United States Patent [19]

Pennypacker

[11] Patent Number: 5,651,911

[45] Date of Patent: Jul. 29, 1997

[54] REMOVABLE INSERT FOR FORMING RECESS

[76] Inventor: J. Edward Pennypacker, 271 Hafner Rd., Royersford, Pa. 19468

[21] Appl. No.: 552,339

[22] Filed: Nov. 2, 1995

[51] Int. Cl.[6] ..... B28B 7/06; B28B 7/16

[52] U.S. Cl. ..... 249/94; 249/91; 249/177; 249/179; 249/183

[58] Field of Search ..... 249/122, 124, 249/91, 142, 94, 95, 96, 177, 179, 183, 63; 403/DIG. 1; 428/343

[56] References Cited

U.S. PATENT DOCUMENTS

| | | | |
|---|---|---|---|
| 4,821,994 | 4/1989 | Fricker | 249/95 |
| 5,004,208 | 4/1991 | Domizio | 249/91 |
| 5,061,112 | 10/1991 | Monford, Jr. | 403/DIG. 1 |
| 5,340,629 | 8/1994 | Rodighiero | 428/343 |
| 5,489,468 | 2/1996 | Davidson | 428/343 |

*Primary Examiner*—Khanh P. Nguyen
*Assistant Examiner*—Robert Hopkins
*Attorney, Agent, or Firm*—Zachary T. Wobensmith, III

[57] ABSTRACT

A removable insert for forming a recess in wet concrete which locates a pulling iron or anchor in wet concrete, and when the concrete hardens the insert is removed, and the anchor may be engaged by a hook and cable to move the resultant concrete structure. The insert, which may be placed at any desired location in the concrete structure, is of a resilient, molded elastomeric material with a central opening to engage the pulling iron or anchor, with a slot therein, which is closed or shaped and which may have a V-shaped removable wedge in the slot. The insert is molded with a flat top with sloping sides, extending downwardly therefrom to a semicircular bottom surface, with threaded inserts in the top which have bolts inserted therein for fastening the insert to a plate and for squeezing to open the slot to permit withdrawal of the insert from the pulling iron or anchor, and which provides a recess, which contains the anchor. The top plate may also have magnets or glue or double-faced tape thereon for attachment to a plate which forms a portion of the mold for the concrete structure.

7 Claims, 5 Drawing Sheets

REMOVABLE INSERT FOR FORMING RECESS

BACKGROUND OF THE INVENTION

1. Field of the Invention

This invention relates to a removable insert for locating a pulling iron or anchor and creating a recess therefor in a concrete structure.

2. Description of the Prior Art

In order to be able to move cast concrete structures such as slabs, boxes, covers, or the like, it is desirable to have a number of lifting points to which a hook and cable from a lifting apparatus such as a crane or hoist can be attached.

It is desirable to have the lifting points as unobstructive as possible and preferably below the structures's surfaces. Various solutions have been proposed to provide recesses for hook attachment such as shown in the U.S. Pat. Nos. to Morley 1,045,587; Cummings 1,244,034; Forni 2,344,206; Dickson 3,298,148; Holt et al 4,386,486; Kelly et al 4,580,378; Courtois et al 4,726,562; Fricker 4,821,994; Domizio 5,004,208; and Kelly et al. 5,226,265 but none of these proposed structures is wholly satisfactory.

The U.S. Pat. No. to Domizio 5,004,208, discloses a removable recess forming insert which is intended to be immersed in wet concrete after pouring, and which carries a stirrup which is intended to be left in the recess after the concrete hardens and the insert is removed. This insert is only suitable for use where its mold thumb protrudes from the concrete and can be accessed by hand, but is not suitable for attachment to a plate which forms part of the mold for a concrete structure. It is also difficult to remove the Domizio insert due to its configuration and its service life is limited due to the wear on the stirrup release slot by the pulling therethrough of the abrasive stirrup.

The insert of the invention does not suffer from the prior art problems and provides many positive advantages.

SUMMARY OF THE INVENTION

A removable insert for forming recesses in concrete structures which locates a pulling iron or anchor in wet concrete, the insert being removable upon hardening of the concrete, providing lifting points for the structure, and which insert can be located in a variety of positions to provide recesses as required.

The principal object of the invention is to provide a removable insert for forming recesses in concrete structures and which also locates a pulling iron or anchor in the recess.

A further object of the invention is to provide a removable insert that is easy to manufacture and long-lasting in use.

A further object of the invention is to provide an insert that can be placed in a multiplicity of positions to provide recesses as desired in a concrete structure.

A further object of the invention is to provide a removable insert that has a variety of mounting options to plates which may form part of a mold for a concrete structure.

A further object of the invention is to provide a removable insert that is easy to use.

Other objects and advantageous features of the invention will be apparent from the specification and claims.

DESCRIPTION OF THE DRAWINGS

The nature and characteristic features of the invention will be more readily understood from the following description taken in connection with the accompanying drawings forming part hereof in which.

Figure 1:
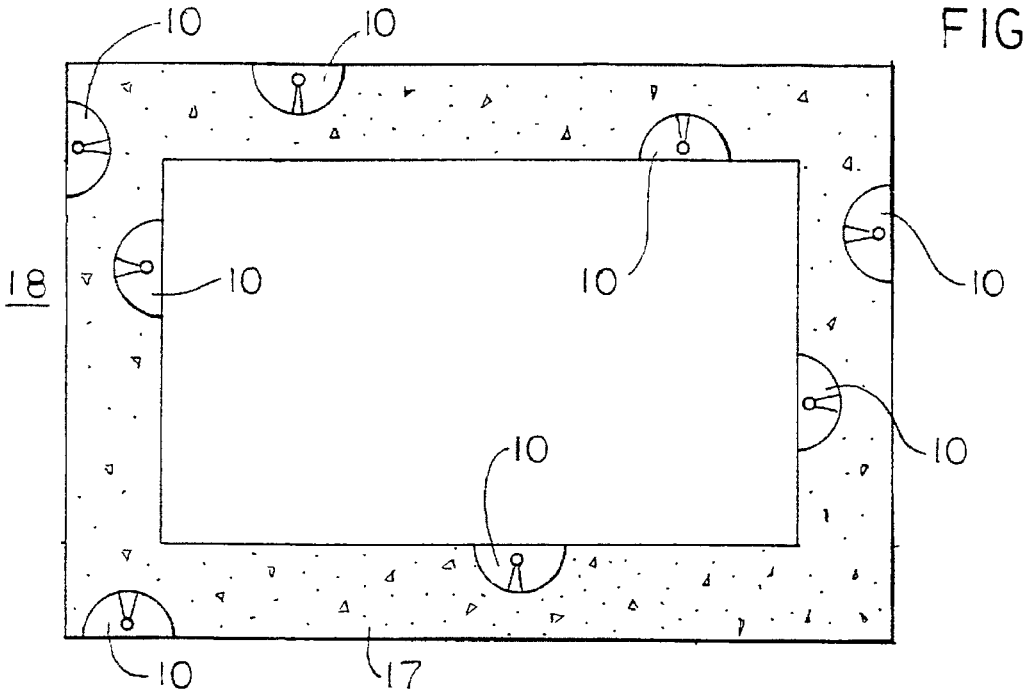
FIG. 1 is a top plan view in partial section showing a plurality of an embodiment of the removable insert of the invention in place in a concrete, box-like structure.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1, 2, 8, and 9 of the drawings, one embodiment of removable insert 10 for forming recesses is therein illustrated.

The insert 10 is formed in a mold of a suitable elastomeric material, which can be urethane of a durometer of 80–90 D.

The insert 10 includes a body 11 which has a flat top face 12, and a semi-circular lower face 14 attached thereto. The top face 12 has front and back faces 15 and 16 extending down to lower face 14, thereby forming the body 11.

The front and back faces 15 and 16 are tapered inwardly as they extend downwardly to face 14 at an angle in the range of 0 to 20 degrees from the vertical, with a 10 degree angle being preferable, and which permits easy extraction of the insert 10 from the wall 17 of a hardened concrete structure 18 as shown in the Figures.

Figure 8:
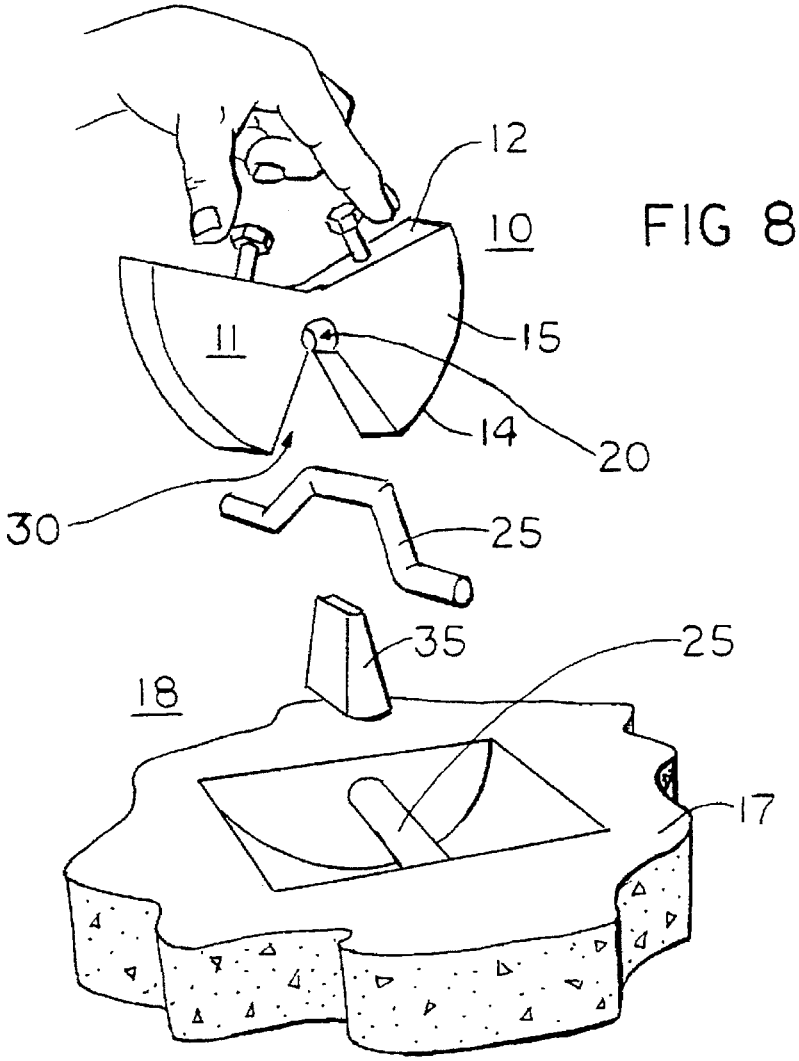
FIG. 8 is an exploded perspective view of an embodiment of the removable insert of the invention illustrating the hinge-like removal feature of the invention.
Figure 9:
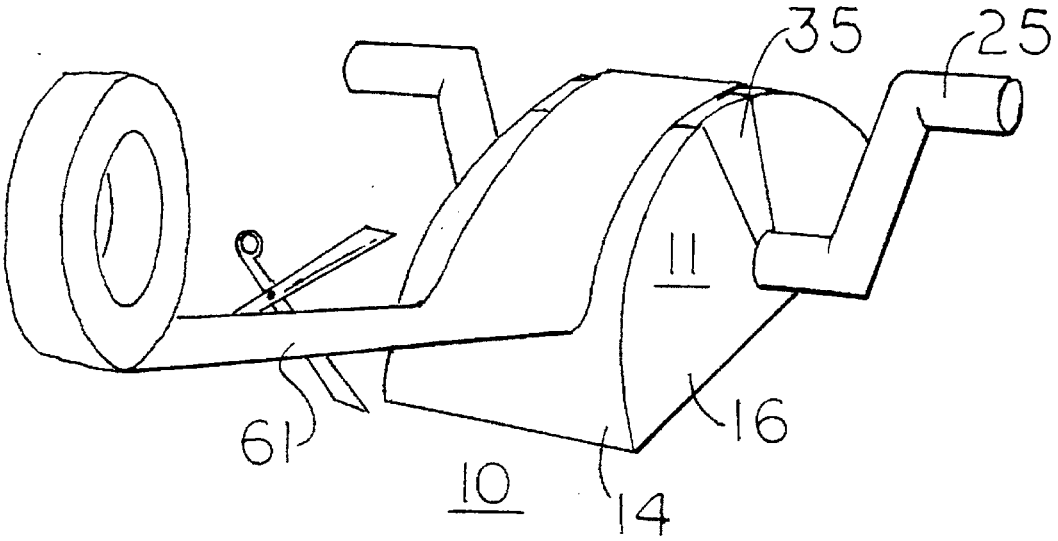
FIG. 9 is a view in perspective of one embodiment of the removable insert of the invention.

The insert 10 at the center of body 11 has an opening 20 therethrough, from face 15 to face 16. The opening 20 is intended to receive a pulling iron or anchor 25 as shown in FIGS. 8 and 9 which can be a formed piece of reinforcing material (REBAR) of desired thickness, depending on the weight and number of lifting points extending down from face 12 required for the concrete structure to be lifted.

Figure 2:
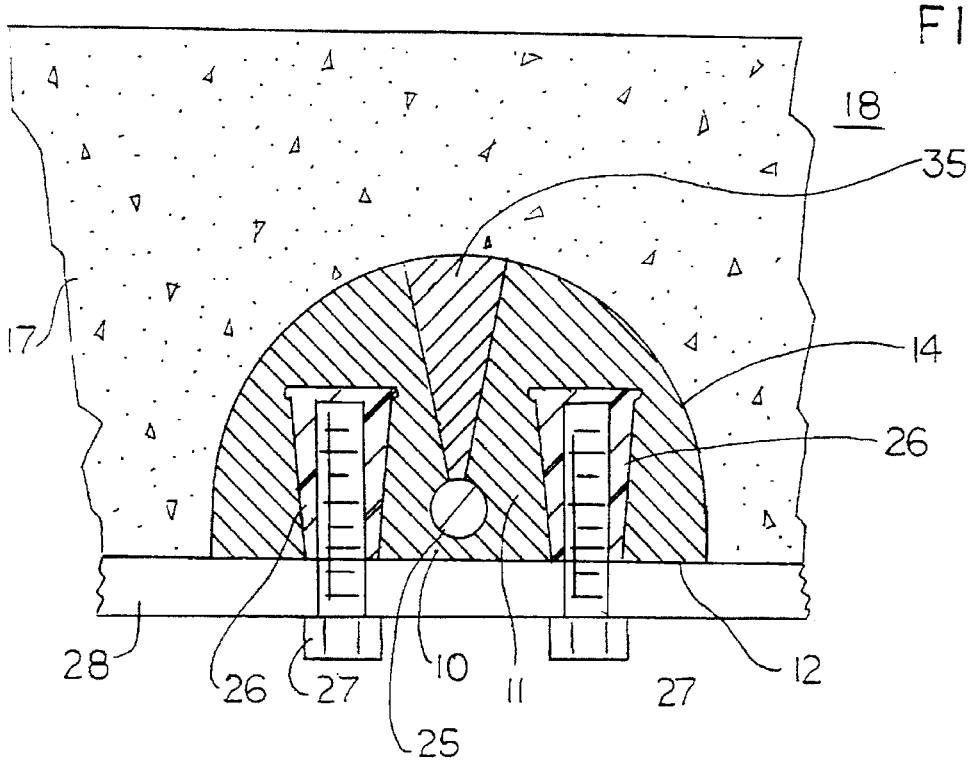
FIG. 2 is a sectional view, enlarged, of one embodiment of the removable insert of the invention, bolted to a plate forming part of a mold for a concrete structure.

The insert 10 has two threaded inserts 26 therein extending down from face 12 which receive bolts 27 for securing it to a plate 28 as shown in FIG. 2, and for removing the insert 10 to be described. The use of bolts 27 to secure the insert 10 to the plate 28 is the preferred method of attachment of the insert. The insert 10 is provided with a V-Shaped slot 30 extending downwardly to lower face 14 and which is intended to receive a V-shaped wedge 35.

Figure 3:
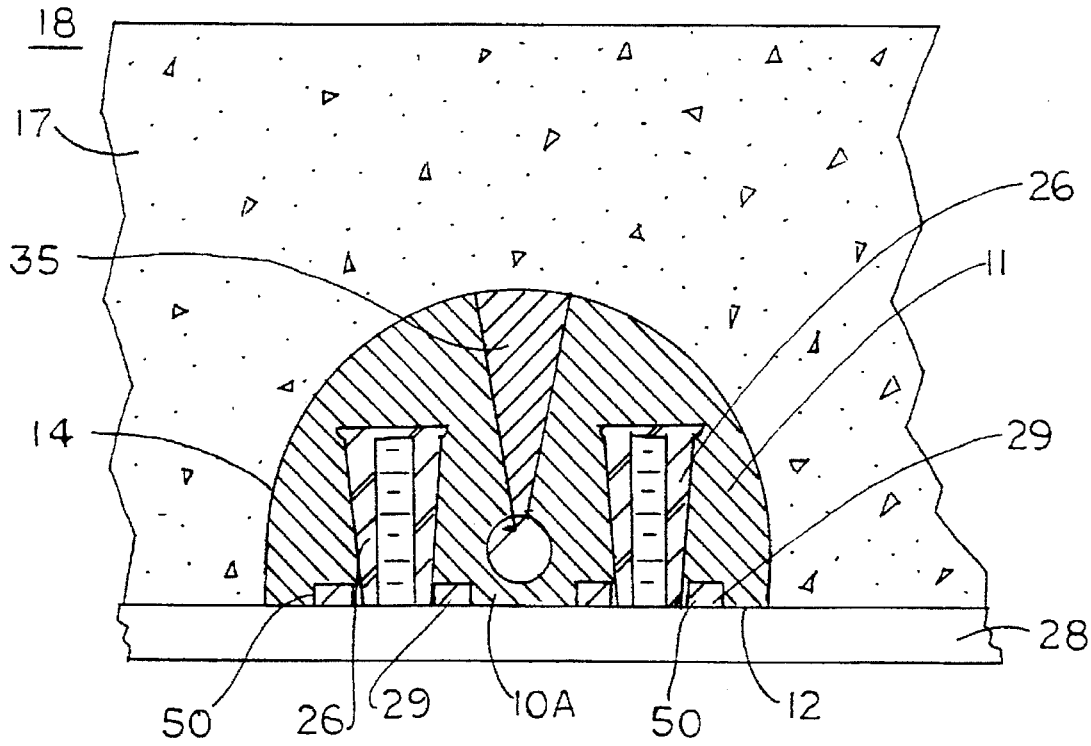
FIG. 3 is a view similar to FIG. 2 but illustrating magnetic retention of the insert to a plate.
Figure 6:
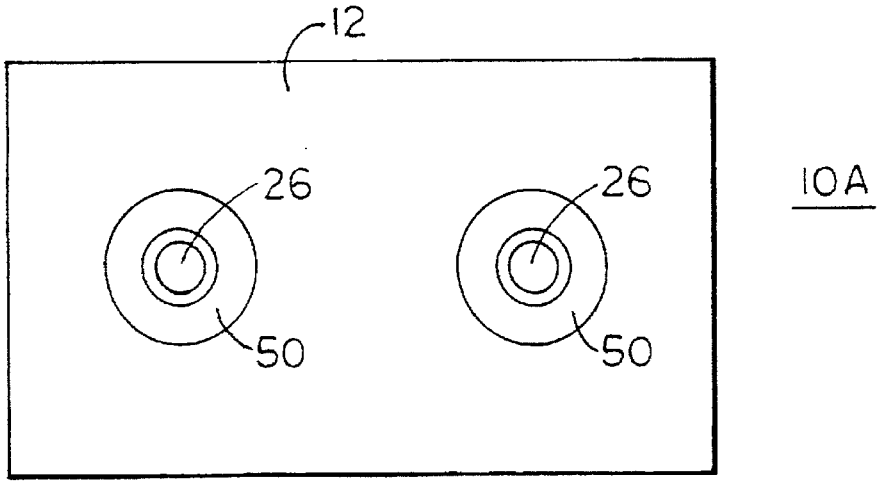
FIG. 6 is a top plan view of the insert of FIG. 2.

Referring now to FIGS. 3 and 6, an insert 10A is shown which is similar to insert 10, but has two recesses 50 in top face 12 around the threaded inserts 26, with magnets 29 therein which are retained therein by any suitable means such as adhesive of well-known type. The use of magnets 29 permits mounting the insert 10A at any desired location on a metal plate 28 from which it can be easily removed and replaced for reuse.

Figure 4:
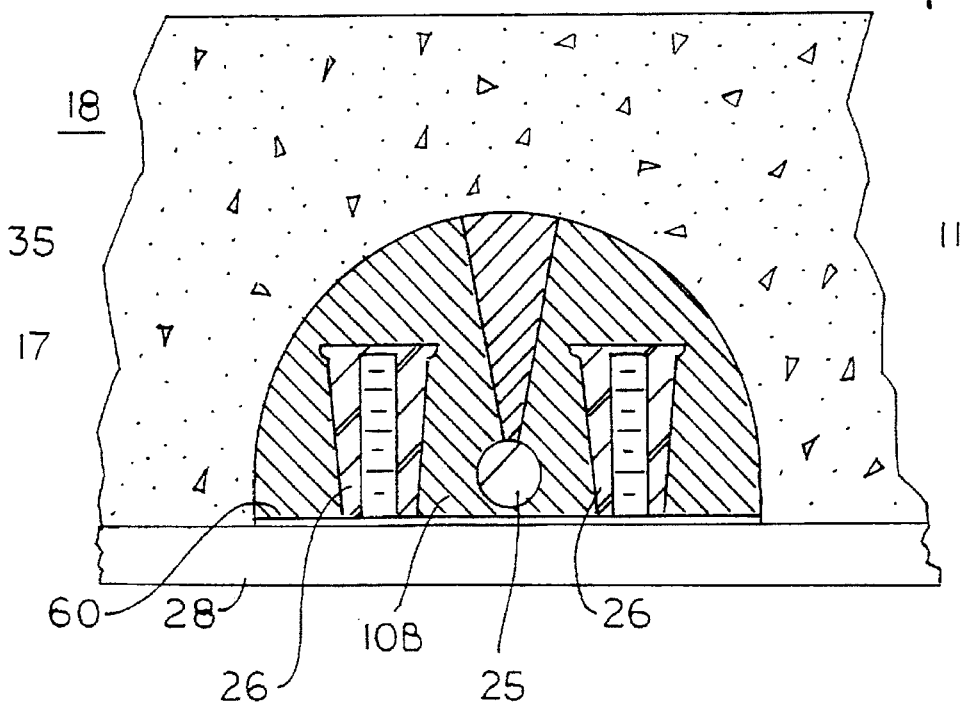
FIG. 4 is a view similar to FIG. 2, but illustrating retention of the insert to the plate by adhesive securement.
Figure 7:
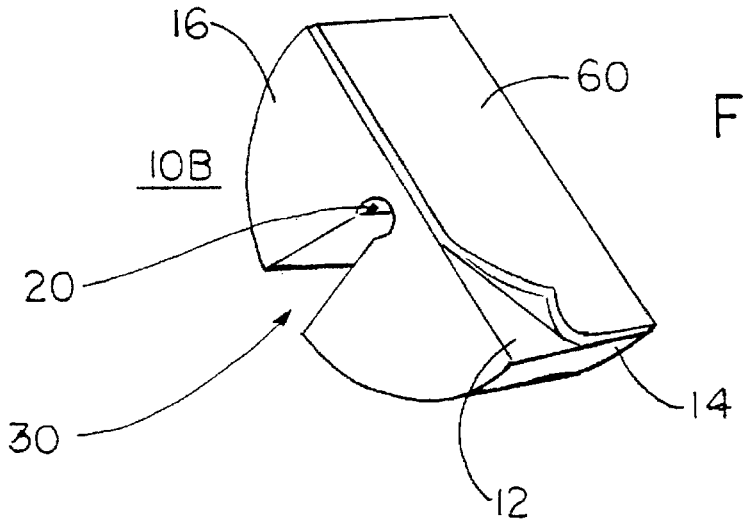
FIG. 7 is a perspective view of one embodiment of a removable insert of the invention illustrating retention of the insert by double-sided adhesive tape.

Referring now to FIGS. 4 and 7, an insert 10B is illustrated, similar to insert 10 which has had a layer of double-faced tape 60 applied to its top face 14 which secures the insert 10 to plate 28. The use of double-faced tape 60 permits the insert 10 to be placed wherever desired in a mold, and is also useful where the mold plate is of non-magnetic material.

The mode of retention of removable insert 10 will now be described.

For use the insert 10 is assembled as shown in FIG. 9 with a piece of tape 61 around lower face 14 retaining a V-wedge 35 and anchor 25 therein. The insert 10 can then be bolted, glued, adhesively or magnetically attached to a plate 28 of a mold for a concrete structure.

After insert 10 placement the wet concrete is poured into the mold, surrounds the insert and hardens. The plate 28 is removed, bolts 27 are threaded into inserts 26 and grasped between two fingers. Pressure is exerted on bolts 27 to cause the top face of the insert to pivot like a hinge and slot 30 to enlarge whereby the wedge 35 is discharged, and the insert 10 withdrawn from the formed recess 75 in the concrete structure 18, with an anchor 25 providing a lifting point. The wedge 35 can then be removed and reused as desired.

Figure 5:
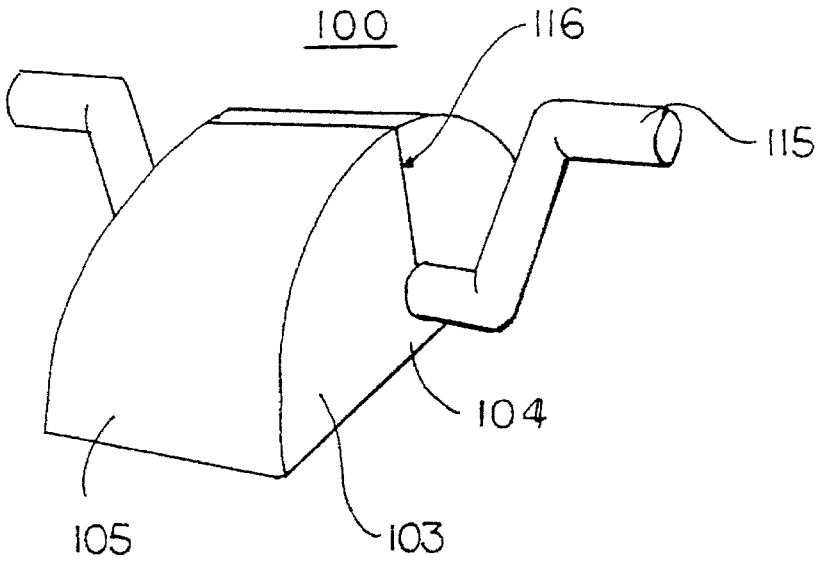
FIG. 5 is a perspective view of an alternate embodiment of the removable insert of the invention with an anchor therein.
Figure 10:
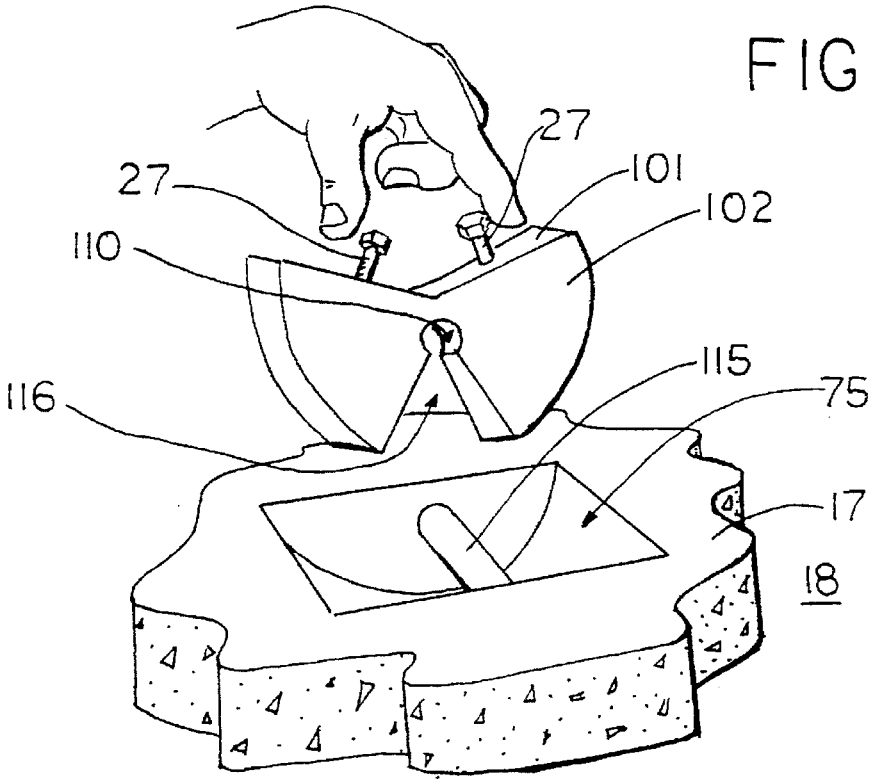
FIG. 10 is an exploded view, illustrating the removal of an alternate embodiment of the insert of the invention from a concrete structure.

Referring now more particularly to FIGS. 5 and 10, an alternate embodiment of removable insert 100 is therein illustrated.

The insert 100 is similar to insert 10 in that it is also molded of an elastomeric material, preferably of urethane with a durometer of 30 to 50 A, with 40 A being preferred.

The insert 10 has a flat top face 101 with front and rear faces 102 and 103 extending down along a body 104 to an accurate lower surface 105. The front and rear faces 102 and 103 taper inwardly as they extend downwardly in an angle with a range of 0 degrees to 20 degrees from the vertical with 10 degrees being the preferred angle.

A pair of threaded inserts (not shown) extend downwardly from top face 101 into the body of the insert 100, and receive bolts 27 as described for insert 10.

The body 104 has an opening 110 therein, which extends from face 102 through the body 104 to face 103, and receives an anchor 115. The anchor 115 is illustrated as formed from a length of REBAR. The opening 110 has a slot 116 extending downwardly to lower surface 105 for anchor 115 insertion and removal.

In operation an anchor 115 is placed in opening 110 and the insert 100 placed in a mold (not shown) as described for insert 10.

Wet concrete is poured around the insert 100 and hardens. The plate (not shown) above insert 100 is removed and bolts 27 inserted into the threaded inserts (not shown) in body 104 and squeezed as shown in FIG. 10 to cause the body to widen slot 116 whereby the insert 100 is free to be withdrawn from a formed recess 120, with anchor 115 passing through slot 116. The insert 100 can then be reassembled to an anchor 115 and reused as desired.

It will thus be seen that inserts have been provided with which the objects of the invention are attained.

I claim:

1. A removable insert of a resilient elastomeric material, for locating an anchor or pulling iron prior to forming a structure of wet concrete, and forming a recess in said concrete to allow a hook to engage said anchor after the concrete hardens which comprises:

a semi-circular body having a flat top face, an arcuate lower face forming the lower portion of said body, front and back faces joining said top face and said lower face and tapering inwardly towards said lower face, an opening extending through said body from said front face to said back face to receive said anchor, a V-shaped slot in said body connecting said opening to said lower surface, a V-shaped wedge removably retained in said slot, means for mounting said insert, a pair of threaded inserts in said body extending perpendicularly downwardly from said top face, into said body, and a pair of bolts for engagement in said inserts by which said body may be squeezed to spread said slot to permit said insert to be removed from said hardened concrete structure providing a recess with a fixed anchor for lifting said structure.

2. A removable insert as defined in claim 1 in which:

said front and back face are angled from the vertical at an angle in the range of 0 to 20 degrees.

3. A removable insert as defined in claim 1 which is of molded construction.

4. A removable insert as defined in claim 1 in which said resilient elastomeric material is urethane.

5. A removable insert as defined in claim 1 in which said means for mounting is a layer of double-faced adhesive tape on said top face.

6. An insert as defined in claim 1 in which said means for mounting is magnetic means secured in said top face.

7. A removable insert of a resilient elastomeric material, for locating an anchor or pulling iron prior to forming a structure of wet concrete, and forming a recess in said concrete to allow a hook to engage said anchor after the concrete hardens which comprises:

a semi-circular body having a flat top face, an arcuate lower face forming the lower portion of said body, front and back faces joining said top face and said lower face and tapering inwardly towards said lower face, an opening extending through said body from said front face to said back face to receive said anchor, a slot in said body connecting said opening to said lower surface, means for mounting said insert, a pair of threaded inserts in said body extending perpendicularly downwardly from said top face, into said body and a pair of bolts for engagement in said inserts by which said body may be squeezed to spread said slot to permit said insert to be removed from said hardened concrete structure providing a recess with a fixed anchor for lifting said structure.

* * * * *